US011621102B2

(12) United States Patent
Abe et al.

(10) Patent No.: US 11,621,102 B2
(45) Date of Patent: Apr. 4, 2023

(54) ELECTRIC WIRE AND WIRE HARNESS

(71) Applicant: Yazaki Corporation, Tokyo (JP)

(72) Inventors: Noriyuki Abe, Susono (JP); Hiroki Kondo, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 17/679,442

(22) Filed: Feb. 24, 2022

(65) Prior Publication Data

US 2022/0319735 A1 Oct. 6, 2022

(30) Foreign Application Priority Data

Apr. 1, 2021 (JP) ..... JP2021-062647

(51) Int. Cl.
*H01B 7/24* (2006.01)
*H01B 7/00* (2006.01)

(52) U.S. Cl.
CPC ..... *H01B 7/0045* (2013.01); *H01B 7/24* (2013.01)

(58) Field of Classification Search
CPC ..... H01B 7/0892; H01B 7/0045; H01B 7/24
USPC ..... 174/72 A
See application file for complete search history.

(56) References Cited

U.S. PATENT DOCUMENTS 3,828,120 A * 8/1974 Hansen ..... H01B 7/041 174/117 FF
4,734,545 A * 3/1988 Susuki ..... H01B 3/443 174/113 A
9,177,695 B2 * 11/2015 Lietz ..... H01M 50/50
10,137,847 B2 * 11/2018 Okamoto ..... H01B 7/0892
11,361,881 B2 * 6/2022 Wang ..... B60R 16/0207
2014/0326479 A1 * 11/2014 Itani ..... H02G 3/04 72/367.1
2018/0056896 A1 * 3/2018 Okamoto ..... B60R 16/0215
2019/0027273 A1 * 1/2019 Oshima ..... H01B 7/0009
2019/0259511 A1 * 8/2019 Ooi ..... H01B 7/292
2020/0251250 A1 * 8/2020 Lyfar ..... H01B 7/04

FOREIGN PATENT DOCUMENTS

DE 4210202 A1 * 9/1993 ..... H01B 7/0009
DE 4210202 A1 9/1993
EP 1701362 A2 * 9/2006 ..... H01B 7/0892
EP 3843110 A1 * 6/2021 ..... B60R 16/0215
JP 2018-101627 A 6/2018
JP 2020-053378 A 4/2020

OTHER PUBLICATIONS

Calmont wire and cable (Year: 2015).*

* cited by examiner

*Primary Examiner* — Timothy J Thompson
*Assistant Examiner* — Michael F McAllister
(74) *Attorney, Agent, or Firm* — Banner & Witcoff, Ltd.

(57) ABSTRACT

An electric wire includes a flat stranded conductor having a flat shape in cross sectional view and configured by a plurality of conductive wires each having a wire diameter of 1.2 mm or less and which are stranded to each other, and a flat covering portion that is an insulator and covers the flat stranded conductor. The flat covering portion has a uniform elongation of 43.5% or more.

3 Claims, 5 Drawing Sheets

FIG. 4

50sq

| | WIRE DIAMETER | BEFORE PRESSING | | AFTER PRESSING | | ELECTRIC WIRE LOW HEIGHT RATE | INSULATOR REDUCTION RATE | UNIFORM ELONGATION OF INSULATOR | CRACKING OF INSULATOR | | WIRE BREAKAG | WEAR RESISTANCE |
|---|---|---|---|---|---|---|---|---|---|---|---|---|
| | | FINISHING OUTER DIAMETER | COVERING THICKNESS | OUTER DIAMETER IN MINOR AXIS DIRECTION | COVERING THICKNESS | | | | | | | |
| | mm | mm | mm | mm | mm | % | % | % | HARD PVC | SOFT PVC | | |
| EXAMPLE 1 COMPARATIVE EXAMPLE 1 | 0.32 | 11.51 | 1.38 | 5.71 | 1.08 | -50.4 | -21.7 | 43.5 | × | ○ | NO | ○ |
| EXAMPLE 2 COMPARATIVE EXAMPLE 2 | 0.52 | 11.67 | 1.41 | 5.82 | 0.81 | -50.1 | -42.6 | 85.1 | × | ○ | NO | ○ |
| EXAMPLE 3 COMPARATIVE EXAMPLE 3 | 1.00 | 12.02 | 1.43 | 5.97 | 0.52 | -50.3 | -63.6 | 127.3 | × | ○ | NO | ○ |
| EXAMPLE 4 COMPARATIVE EXAMPLE 4 | 1.20 | 12.07 | 1.43 | 6.05 | 0.42 | -49.9 | -70.6 | 141.3 | × | ○ | YES | × |

FIG. 5

16sq

| | WIRE DIAMETER | BEFORE PRESSING | | AFTER PRESSING | | ELECTRIC WIRE LOW HEIGHT RATE | INSULATOR REDUCTION RATE | UNIFORM ELONGATION OF INSULATOR | CRACKING OF INSULATOR | | WIRE BREAKAG | WEAR RESISTANCE |
|---|---|---|---|---|---|---|---|---|---|---|---|---|
| | | FINISHING OUTER DIAMETER | COVERING THICKNESS | OUTER DIAMETER IN MINOR AXIS DIRECTION | COVERING THICKNESS | | | | HARD PVC | SOFT PVC | | |
| | mm | mm | mm | mm | mm | % | % | % | | | | |
| EXAMPLE 5 | 0.32 | 7.95 | 0.99 | 3.99 | 0.77 | -49.8 | -22.2 | 44.4 | × | ○ | NO | ○ |
| COMPARATIVE EXAMPLE 5 | | | | | | | | | | | | |
| EXAMPLE 6 | 0.52 | 8.01 | 1.05 | 4.00 | 0.62 | -50.1 | -40.9 | 81.7 | × | ○ | NO | ○ |
| COMPARATIVE EXAMPLE 6 | | | | | | | | | | | | |
| EXAMPLE 7 | 1.00 | 8.11 | 1.07 | 4.05 | 0.41 | -50.1 | -61.7 | 123.4 | × | ○ | NO | ○ |
| COMPARATIVE EXAMPLE 7 | | | | | | | | | | | | |
| EXAMPLE 8 | 1.20 | 8.14 | 1.11 | 4.11 | 0.32 | -49.5 | -71.2 | 142.3 | × | ○ | YES | × |
| COMPARATIVE EXAMPLE 8 | | | | | | | | | | | | |

FIG. 6

30sq

| | WIRE DIAMETER | BEFORE PRESSING | | AFTER PRESSING | | ELECTRIC WIRE LOW HEIGHT RATE | INSULATOR REDUCTION RATE | UNIFORM ELONGATION OF INSULATOR | CRACKING OF INSULATOR | | WIRE BREAKAG | WEAR RESISTANCE |
|---|---|---|---|---|---|---|---|---|---|---|---|---|
| | | FINISHING OUTER DIAMETER | COVERING THICKNESS | OUTER DIAMETER IN MINOR AXIS DIRECTION | COVERING THICKNESS | | | | | | | |
| | mm | mm | mm | mm | mm | % | % | % | HARD PVC | SOFT PVC | | |
| EXAMPLE 9 | 0.32 | 10.32 | 1.28 | 5.14 | 0.99 | -50.1 | -22.7 | 45.3 | × | ○ | NO | ○ |
| COMPARATIVE EXAMPLE 9 | | | | | | | | | | | | |
| EXAMPLE 10 | 0.52 | 10.35 | 1.29 | 5.13 | 0.75 | -50.4 | -41.9 | 83.7 | × | ○ | NO | ○ |
| COMPARATIVE EXAMPLE 10 | | | | | | | | | | | | |
| EXAMPLE 11 | 1.00 | 10.89 | 1.29 | 5.31 | 0.51 | -50.9 | -60.5 | 120.9 | × | ○ | NO | ○ |
| COMPARATIVE EXAMPLE 11 | | | | | | | | | | | | |
| EXAMPLE 12 | 1.20 | 10.86 | 1.31 | 5.39 | 0.39 | -50.4 | -70.2 | 140.5 | × | ○ | YES | × |
| COMPARATIVE EXAMPLE 12 | | | | | | | | | | | | |

ELECTRIC WIRE AND WIRE HARNESS

CROSS-REFERENCE TO RELATED APPLICATIONS

This application is based on and claims priority under 35 USC 119 from Japanese Patent Application No. 2021-062647 filed on Apr. 1, 2021, the contents of which are incorporated herein by reference.

TECHNICAL FIELD

The present disclosure relates to an electric wire and a wire harness.

BACKGROUND ART

In the related art, with the need for expansion of a vehicle interior space, it is required to route electric wires in a narrow routing space. Here, in a case of a round electric wire, a height of a routing space is increased, and it may be difficult to perform routing the round electric wire in a narrow space. Therefore, a flat electric wire in which a flat conductor having a flat shape is covered with an insulator may be used. However, when the flat conductor is formed of a single plate, bending and vibration durability of the flat conductor is not high at all.

Therefore, an electric wire having a flat shape is proposed. The electric wire having the flat shape is obtained by pressing a round electric wire having a conductor portion which is constituted by a plurality of conductor wires. According to the electric wire, since the conductor portion is constituted by the plurality of conductor wires, bending durability and vibration durability of the electric wire can be improved (see, for example, JP-A-2018-101627).

However, the electric wire described in JP-A-2018-101627 may have cracks in an insulator which covers the conductor portion of the electric wire during pressing or the like, and may not satisfy the expected electric wire characteristics.

SUMMARY OF INVENTION

The present disclosure has been made to solve such a related-art problem, and an object thereof is to provide an electric wire and a wire harness capable of improving bending durability and vibration durability, and reducing a possibility of cracking of an insulator covering a conductor portion of the electric wire.

Aspect of non-limiting embodiments of the present disclosure relates to provide an electric wire including: a flat stranded conductor having a flat shape in cross sectional view and configured by a plurality of conductive wires each having a wire diameter of 1.2 mm or less and which are stranded to each other; and a flat covering portion that is an insulator and covers the flat stranded conductor, in which the flat covering portion has a uniform elongation of 43.5% or more.

According to the present disclosure, bending durability and vibration durability can be improved, and a possibility of cracking of the insulator can be reduced.

BRIEF DESCRIPTION OF DRAWINGS

FIGS. 3A and 3B are schematic views each showing an example of a manufacturing process, in which FIG. 3A shows the manufacturing process of an electric wire according to a comparative example, and FIG. 3B shows the manufacturing process of the electric wire according to the present embodiment;

FIG. 4 is a first table showing examples and comparative examples;

FIG. 5 is a second table showing examples and comparative examples; and

FIG. 6 is a third table showing examples and comparative examples.

DESCRIPTION OF EMBODIMENTS

Hereinafter, the present disclosure will be described in accordance with an exemplary embodiment. The present disclosure is not limited to the embodiment to be described below, and can be changed as appropriate without departing from the gist of the present disclosure. In addition, although some configurations are not shown or described in the embodiment to be described below, it goes without saying that a known or well-known technique is applied as appropriate to details of an omitted technique within a range in which no contradiction occurs to contents to be described below.

Figure 1:
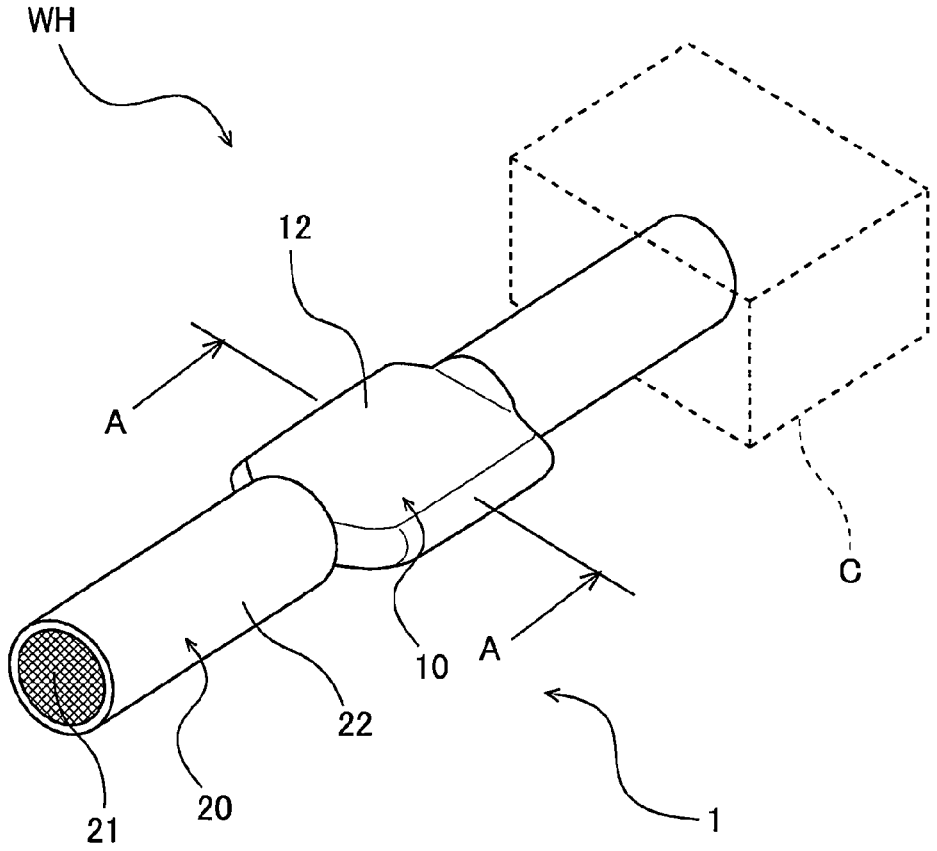
FIG. 1 is a configuration view showing an example of a wire harness including an electric wire according to an embodiment of the present disclosure.

FIG. 1 is a configuration view showing an example of a wire harness including an insulated electric wire according to an embodiment of the present disclosure. As shown in FIG. 1, a wire harness WH includes an electric wire 1 and a connector C to be described in detail below.

For example, a terminal (not shown) is crimped or the like to the electric wire 1. The terminal is accommodated in a terminal accommodating chamber of the connector C. The wire harness WH may include an exterior member such as a corrugated tube (not shown) that covers a periphery of the electric wire 1, or may include an electric wire of a type different from that of the electric wire 1. When the wire harness WH includes another electric wire, the electric wire 1 may be wound with a tape together with the another electric wire. The wire harness WH may include two or more electric wires 1. The connector C is not essential for the wire harness WH.

Figure 2:
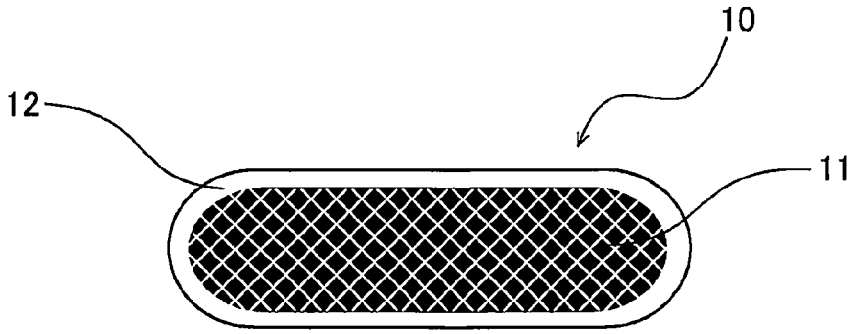
FIG. 2 is a cross-sectional view taken along a line A-A in FIG. 1.

As shown in FIG. 1, the electric wire 1 includes a flat electric wire portion 10 and a round electric wire portion 20. FIG. 2 is a cross-sectional view taken along a line A-A in FIG. 1

As shown in FIG. 2, the flat electric wire portion 10 includes a flat stranded conductor 11, and a flat covering portion 12 that is an insulator covering the flat stranded conductor 11. The flat stranded conductor 11 is a conductor portion having a flat shape in cross sectional view and formed by stranding a plurality of conductive wires having a wire diameter of 1.2 mm or less. In the flat stranded conductor 11, the plurality of conductive wires are made of, for example, aluminum or an alloy thereof. The conductive wires are not limited to those made of aluminum or an alloy thereof, and may be made of copper or an alloy thereof, or may be those obtained by plating a metal or a fiber, as long as the wires are conductive.

The round electric wire portion 20 shown in FIG. 1 includes a round stranded conductor 21, and a round covering portion 22 that is an insulator covering the round stranded conductor 21. The round stranded conductor 21 is a conductor portion having a round shape in cross sectional view and formed by stranding a plurality of conductive wires having a wire diameter of 1.2 mm or less. Also in the round stranded conductor 21, the plurality of conductive wires are made of, for example, aluminum or an alloy thereof. The conductive wires are not limited to those made of aluminum or an alloy thereof, and may be made of copper or an alloy thereof, or may be those obtained by plating a metal or a fiber, as long as the wires are conductive.

The flat electric wire portion 10 in the present embodiment is formed by, for example, pressing process or rolling process to the round electric wire portion 20. The flat stranded conductor 11 and the round stranded conductor 21 are continuously formed in the same conductive wires. The flat covering portion 12 and the round covering portion 22 also continuously cover the flat stranded conductor 11 and the round stranded conductor 21.

Figure 3A:
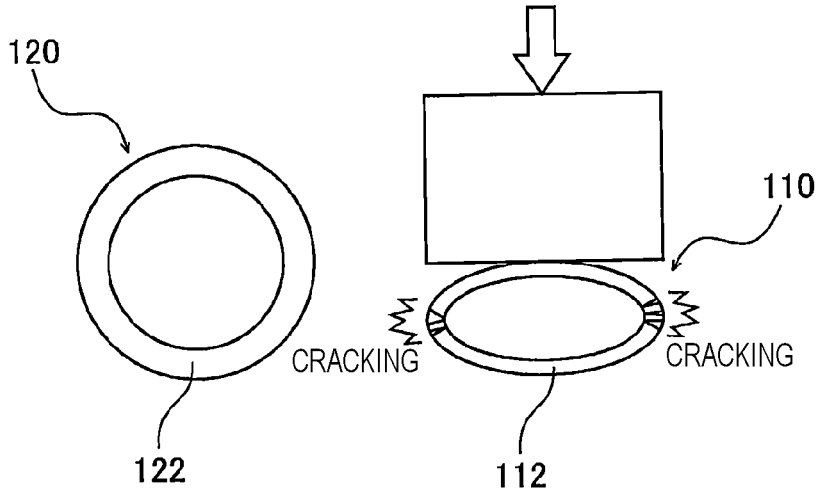
Figure 3B:
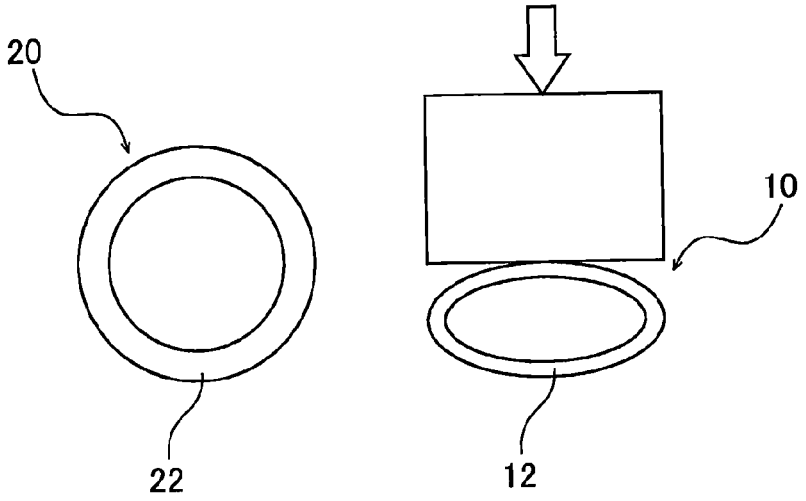

Here, in the present embodiment, the flat covering portion 12 and the round covering portion 22 are made of a material having a uniform elongation of 43.5% or more (for example, soft polyvinyl chloride (PVC)). FIGS. 3A and 3B are schematic views showing an example of a manufacturing process, in which FIG. 3A shows the manufacturing process of an electric wire according to a comparative example, and FIG. 3B shows the manufacturing process of the electric wire 1 according to the present embodiment.

As shown in FIG. 3A, in the comparative example, a flat electric wire portion 110 is manufactured by pressing or the like of a round electric wire portion 120. During the pressing, a portion of a flat covering portion 112, in particular on an outer peripheral portion thereof, is stretched. Therefore, when a uniform elongation of covering portions 112 and 122 is small, the flat covering portion 112 is cracked to be torn from the outer peripheral portion as shown in FIG. 3A.

As shown in FIG. 3B, also in the present embodiment, the flat electric wire portion 10 is manufactured by pressing or the like of the round electric wire portion 20. Here, the uniform elongation of the covering portions 12 and 22 in the present embodiment is set to 43.5% or more. Therefore, even if outer peripheral portions of the covering portions 12 and 22 are stretched during the pressing or the like, the covering portions 12 and 22 withstand the stretching, and are prevented from being torn from the outer peripheral portions, respectively. Therefore, as shown in FIG. 3B, the flat covering portion 12 is prevented from being cracked.

Further, a diameter of each wire of the electric wire 1 in the present embodiment is preferably 1.00 mm or less. When the round electric wire portion 20 is pressed or rolled, the round electric wire portion 20 is changed to have a flat shape in a manner that the conductive wires inside thereof move between the conductive wires or the like. Here, when the diameter of the wire is 1.00 mm or less, a repulsion of the conductive wires during the pressing or the like is small, and a deformation of the covering portions 12 and 22 can be reduced, and decrease amounts of thicknesses of the covering portions 12 and 22 can be reduced as compared with a case where a wire diameter is more than 1.00 mm. As a result, wear resistance can be ensured, and wire breakage can be prevented.

Specifically, in the electric wire 1 according to the present embodiment, by setting the wire diameter to be 1.00 mm or less, a thickness (of a thinnest portion) of the flat covering portion 12 of the flat electric wire portion 10 is "0.364 (36.4%)" or more when a thickness of the round covering portion 22 of the round electric wire portion 20 is set to "1". As a result of pressing or rolling the electric wire 1 according to the present embodiment, the insulator is thinner at an end portion on a long axis side of the flat shape than at an end portion on a short axis side.

Next, examples and comparative examples of the present disclosure will be described. FIG. 4 is a first table showing examples and comparative examples.

First, in each of Example 1 and Comparative Example 1, aluminum wires were used, and a conductor portion was set to 50 sq (JIS). A wire diameter was 0.32 mm, and a finishing outer diameter before pressing or rolling (that is, a state of a round electric wire portion) was 11.51 mm. A covering thickness at this time was 1.38 mm.

Such a round electric wire portion was pressed such that an electric wire low height rate was about −50% (−50.4%) (that is, the round electric wire portion was pressed such that a height thereof was about half). An outer diameter in a minor axis direction was 5.71 mm, and a covering thickness of a thinnest portion was 1.08 mm. At this time, a uniform elongation without cracking of an insulator was calculated to be 43.5%. An insulator reduction rate was −21.7%. In Example 1, soft PVC was used for a covering portion, and in Comparative Example 1, hard PVC was used for a covering portion.

In each of Example 2 and Comparative Example 2, aluminum wires were used, and a conductor portion was set to 50 sq (JIS). A wire diameter was 0.52 mm, and a finishing outer diameter before pressing or rolling (that is, a state of a round electric wire portion) was 11.67 mm. A covering thickness at this time was 1.41 mm.

Such a round electric wire portion was pressed such that an electric wire low height rate was about −50% (−50.1%) (that is, the round electric wire portion was pressed such that a height thereof was about half). An outer diameter in a minor axis direction was 5.82 mm, and a covering thickness of a thinnest portion was 0.81 mm. At this time, a uniform elongation without cracking of an insulator was calculated to be 85.1%. An insulator reduction rate was −42.6%. In Example 2, soft PVC was used for a covering portion, and in Comparative Example 2, hard PVC was used for a covering portion.

In each of Example 3 and Comparative Example 3, aluminum wires were used, and a conductor portion was set to 50 sq (JIS). A wire diameter was 1.00 mm, and a finishing outer diameter before pressing or rolling (that is, a state of a round electric wire portion) was 12.02 mm. A covering thickness at this time was 1.43 mm.

Such a round electric wire portion was pressed such that an electric wire low height rate was about −50% (−50.3%) (that is, the round electric wire portion was pressed such that a height thereof was about half). An outer diameter in a minor axis direction was 5.97 mm, and a covering thickness of a thinnest portion was 0.52 mm. At this time, a uniform elongation without cracking of an insulator was calculated to be 127.3%. An insulator reduction rate was −63.6%. In Example 3, soft PVC was used for a covering portion, and in Comparative Example 3, hard PVC was used for a covering portion.

In each of Example 4 and Comparative Example 4, aluminum wires were used, and a conductor portion was set to 50 sq (JIS). A wire diameter was 1.20 mm, and a finishing outer diameter before pressing or rolling (that is, a state of a round electric wire portion) was 12.07 mm. A covering thickness at this time was 1.43 mm.

Such a round electric wire portion was pressed such that an electric wire low height rate was about −50% (−49.9%) (that is, the round electric wire portion was pressed such that a height thereof was about half). An outer diameter in a minor axis direction was 6.05 mm, and a covering thickness of a thinnest portion was 0.42 mm. At this time, a uniform elongation without cracking of an insulator was calculated to be 141.3%. An insulator reduction rate was −70.6%. In Example 4, soft PVC was used for a covering portion, and in Comparative Example 4, hard PVC was used for a covering portion.

FIG. 5 is a second table showing examples and comparative examples.

First, in each of Example 5 and Comparative Example 5, aluminum wires were used, and a conductor portion was set to 16 sq (JIS). A wire diameter was 0.32 mm, and a finishing outer diameter before pressing or rolling (that is, a state of a round electric wire portion) was 7.95 mm. A covering thickness at this time was 0.99 mm.

Such a round electric wire portion was pressed such that an electric wire low height rate was about −50% (−49.8%) (that is, the round electric wire portion was pressed such that a height thereof was about half). An outer diameter in a minor axis direction was 3.99 mm, and a covering thickness of a thinnest portion was 0.77 mm. At this time, a uniform elongation without cracking of an insulator was calculated to be 44.4%. An insulator reduction rate was −22.2%. In Example 5, soft PVC was used for a covering portion, and in Comparative Example 5, hard PVC was used for a covering portion.

In each of Example 6 and Comparative Example 6, aluminum wires were used, and a conductor portion was set to 16 sq (JIS). A wire diameter was 0.52 mm, and a finishing outer diameter before pressing or rolling (that is, a state of a round electric wire portion) was 8.01 mm. A covering thickness at this time was 1.05 mm.

Such a round electric wire portion was pressed such that an electric wire low height rate was about −50% (−50.1%) (that is, the round electric wire portion was pressed such that a height thereof was about half). An outer diameter in a minor axis direction was 4.00 mm, and a covering thickness of a thinnest portion was 0.62 mm. At this time, a uniform elongation without cracking of an insulator was calculated to be 81.7%. An insulator reduction rate was −40.9%. In Example 6, soft PVC was used for a covering portion, and in Comparative Example 6, hard PVC was used for a covering portion.

In each of Example 7 and Comparative Example 7, aluminum wires were used, and a conductor portion was set to 16 sq (JIS). A wire diameter was 1.00 mm, and a finishing outer diameter before pressing or rolling (that is, a state of a round electric wire portion) was 8.11 mm. A covering thickness at this time was 1.07 mm.

Such a round electric wire portion was pressed such that an electric wire low height rate was about −50% (−50.1%) (that is, the round electric wire portion was pressed such that a height thereof was about half). An outer diameter in a minor axis direction was 4.05 mm, and a covering thickness of a thinnest portion was 0.41 mm. At this time, a uniform elongation without cracking of an insulator was calculated to be 123.4%. An insulator reduction rate was −61.7%. In Example 7, soft PVC was used for a covering portion, and in Comparative Example 7, hard PVC was used for a covering portion.

In each of Example 8 and Comparative Example 8, aluminum wires were used, and a conductor portion was set to 16 sq (JIS). A wire diameter was 1.20 mm, and a finishing outer diameter before pressing or rolling (that is, a state of a round electric wire portion) was 8.14 mm. A covering thickness at this time was 1.11 mm.

Such a round electric wire portion was pressed such that an electric wire low height rate was about −50% (−49.5%) (that is, the round electric wire portion was pressed such that a height thereof was about half). An outer diameter in a minor axis direction was 4.11 mm, and a covering thickness of a thinnest portion was 0.32 mm. At this time, a uniform elongation without cracking of an insulator was calculated to be 142.3%. An insulator reduction rate was −71.2%. In Example 8, soft PVC was used for a covering portion, and in Comparative Example 8, hard PVC was used for a covering portion.

FIG. 6 is a third table showing examples and comparative examples.

First, in each of Example 9 and Comparative Example 9, aluminum wires were used, and a conductor portion was set to 30 sq (JIS). A wire diameter was 0.32 mm, and a finishing outer diameter before pressing or rolling (that is, a state of a round electric wire portion) was 10.32 mm. A covering thickness at this time was 1.28 mm.

Such a round electric wire portion was pressed such that an electric wire low height rate was about −50% (−50.1%) (that is, the round electric wire portion was pressed such that a height thereof was about half). An outer diameter in a minor axis direction was 5.14 mm, and a covering thickness of a thinnest portion was 0.99 mm. At this time, a uniform elongation without cracking of an insulator was calculated to be 45.3%. An insulator reduction rate was −22.7%. In Example 9, soft PVC was used for a covering portion, and in Comparative Example 9, hard PVC was used for a covering portion.

In each of Example 10 and Comparative Example 10, aluminum wires were used, and a conductor portion was set to 30 sq (JIS). A wire diameter was 0.52 mm, and a finishing outer diameter before pressing or rolling (that is, a state of a round electric wire portion) was 10.35 mm. A covering thickness at this time was 1.29 mm.

Such a round electric wire portion was pressed such that an electric wire low height rate was about −50% (−50.4%) (that is, the round electric wire portion was pressed such that a height thereof was about half). An outer diameter in a minor axis direction was 5.13 mm, and a covering thickness of a thinnest portion was 0.75 mm. At this time, a uniform elongation without cracking of an insulator was calculated to be 83.7%. An insulator reduction rate was −41.9%. In Example 10, soft PVC was used for a covering portion, and in Comparative Example 10, hard PVC was used for a covering portion.

In each of Example 11 and Comparative Example 11, aluminum wires were used, and a conductor portion was set to 30 sq (JIS). A wire diameter was 1.00 mm, and a finishing outer diameter before pressing or rolling (that is, a state of a round electric wire portion) was 10.89 mm. A covering thickness at this time was 1.29 mm.

Such a round electric wire portion was pressed such that an electric wire low height rate was about −50% (−50.9%) (that is, the round electric wire portion was pressed such that a height thereof was about half). An outer diameter in a minor axis direction was 5.31 mm, and a covering thickness of a thinnest portion was 0.51 mm. At this time, a uniform elongation without cracking of an insulator was calculated to be 120.9%. An insulator reduction rate was −60.5%. In Example 11, soft PVC was used for a covering portion, and in Comparative Example 11, hard PVC was used for a covering portion.

In each of Example 12 and Comparative Example 12, aluminum wires were used, and a conductor portion was set to 30 sq (JIS). A wire diameter was 1.20 mm, and a finishing outer diameter before pressing or rolling (that is, a state of a round electric wire portion) was 10.86 mm. A covering thickness at this time was 1.31 mm.

Such a round electric wire portion was pressed such that an electric wire low height rate was about −50% (−50.4%) (that is, the round electric wire portion was pressed such that a height thereof was about half). An outer diameter in a minor axis direction was 5.39 mm, and a covering thickness of a thinnest portion was 0.39 mm. At this time, a uniform elongation without cracking of an insulator was calculated to be 140.5%. An insulator reduction rate was −70.2%. In Example 12, soft PVC was used for a covering portion, and in Comparative Example 12, hard PVC was used for a covering portion.

With respect to Examples 1 to 12 and Comparative Examples 1 to 12 as described above, it was visually confirmed whether the insulators are cracked. Further, in Examples 1 to 12, the insulators were peeled off, and it was visually confirmed whether the conductive wires are broken. Further, a wear test (sandpaper wear test) was performed. In the sandpaper wear test, garnet P150 specified in JIS R 6251 was used as a wear tape, and the wear test was performed in accordance with a wear test (sandpaper wear) standard of ISO 6722-1 (5.12.4.1). In this test, the wear tape was moved on an insulating covering layer (the thinnest portion) under an environment of normal temperature (23° C.) in a state in which a weight of 1900 g was attached to a support rod. Then, even though a moving distance of the wear tape was 3430 mm or more, a case where no electric conduction was established between a metal conductor and the wear tape was evaluated as "0", and a case where an electric conduction was established when a moving distance of the wear tape was less than 3430 mm was evaluated as "x".

As a result of the test as described above, in Examples 1 to 12 in which the soft PVC was used as the insulators, the insulators were not cracked. On the other hand, in Comparative Examples 1 to 12 in which the hard PVC was used as the insulators, all the insulators were cracked. It can be said that the reason therefor is that the soft PVC satisfies a required uniform elongation of the insulator, and the hard PVC does not satisfy the required uniform elongation.

In addition, in Examples 1 to 3, 5 to 7, and 9 to 11, no wire breakage was confirmed, and the wear resistance test was evaluated as "○". On the other hand, in Examples 4, 8, and 12, wire breakage was confirmed, and the wear resistance test was evaluated as "x". That is, it was found that it is preferable to keep an insulator reduction rate at least to −63.6% as in Example 3, and in a case where a wall pressure of an original insulator is set to "1", when a thickness (of a thinnest portion) of an insulator of a flat electric wire portion is "0.364 (36.4%)" or more, good results are obtained in terms of wire breakage and wear resistance.

Further, although detailed description is omitted, it was also confirmed that a covering thickness before pressing is not particularly limited to the values in Examples 1 to 12 as long as the covering thickness is within a range satisfying JASO D 618.

As shown in FIGS. 4 to 6, it was also confirmed that a uniform elongation of an insulator for preventing all the insulators from being cracked is not substantially affected by a cross-sectional area of a conductor.

In the above examples and comparative examples, the electric wire low height rate is about −50%, and when an electric wire low height rate is about −50% (strictly, −50.9%) or more (when an absolute value thereof is about 50% or less), a required uniform elongation of an insulator (a required uniform elongation) is small, and thus it goes without saying that cracking is further prevented.

As described above, the electric wire 1 and the wire harness WH according to the present embodiment include the flat stranded conductor 11 having the flat cross section and formed by stranding the plurality of conductive wires, and thus can improve bending durability and vibration durability as compared with a case where a conductor portion is constituted by a single plate. In addition, the uniform elongation of the flat covering portion 12 is 43.5% or more, and thus the flat covering portion 12 is easily elongated when formed by pressing or the like, and a possibility of cracking of the flat covering portion 12 during the pressing or the like can be reduced. Therefore, the bending durability and the vibration durability can be improved, and a possibility of cracking of the insulator can be reduced.

In addition, the round stranded conductor 21 is formed continuously with the flat stranded conductor 11, and thus it is not necessary to joint a round electric wire and a flat electric wire, and a jointless configuration can be achieved. Further, the thickness of the flat covering portion 12 is set to 36.4% or more of the thickness of the round covering portion 22, and thus it is possible to prevent a situation in which the thickness of the flat covering portion 12 formed by pressing or rolling is extremely thin and wear resistance is greatly reduced.

Although the present disclosure has been described based on the embodiment, the present disclosure is not limited to the embodiment described above. The present disclosure may be modified as appropriate without departing from the gist of the present disclosure, or known and well-known techniques may be assembled as appropriate.

For example, the electric wire 1 according to the present embodiment includes the flat electric wire portion 10 and the round electric wire portion 20, but is not limited thereto, and may be constituted by the flat electric wire portion 10 alone by pressing or the like of the entire round electric wire portion 20. In addition, in Examples 1 to 12, the soft PVC was used as the insulators, but the present disclosure is not limited thereto, and the soft PVC may not be used as long as the required uniform elongation can be ensured.

Here, characteristics of the above embodiments of the electric wire and the wire harness according to the present disclosure will be briefly summarized and listed in the following [1] to [3].

[1] An electric wire (1) including:

a flat stranded conductor (11) having a flat shape in cross sectional view and configured by a plurality of conductive wires each having a wire diameter of 1.2 mm or less and which are stranded to each other; and a flat covering portion (12) that is an insulator and covers the flat stranded conductor (11), in which the flat covering portion (12) has a uniform elongation of 43.5% or more.

[2] The electric wire according to the above item [1], further including:

a round stranded conductor (21) having a round shape in cross sectional view and configured by a plurality of conductive wires each having a wire diameter of 1.2 mm or less and which are stranded to each other; and a round covering portion (22) that is an insulator and covers the round stranded conductor (21), in which the plurality of conductive wires of the round stranded conductor (21) are formed continuously by the same wires as the plurality of conductive wires of the flat stranded conductor (11), the round covering portion (22) is formed continuously with the flat covering portion (12), and a thickness of the flat covering portion (12) is set to 36.4% or more of a thickness of the round covering portion (22).

[3] A wire harness (WH) including:

the electric wire according to the above item [1] or [2].

What is claimed is:

1. An electric wire comprising:

a flat stranded conductor having a flat shape in cross sectional view and configured by a plurality of conductive wires each having a wire diameter of 1.2 mm or less and which are stranded to each other; and a flat covering portion that is an insulator and covers the flat stranded conductor, wherein:

the flat covering portion is formed by a pressing or rolling process, and the flat covering portion has a uniform elongation of 43.5% or more such that cracking of the flat covering portion during the pressing or rolling process is prevented.

2. The electric wire according to claim 1, further comprising:

a round stranded conductor having a round shape in cross sectional view and configured by a plurality of conductive wires each having a wire diameter of 1.2 mm or less and which are stranded to each other; and a round covering portion that is an insulator and covers the round stranded conductor, wherein the plurality of conductive wires of the round stranded conductor are formed continuously by the same wires as the plurality of conductive wires of the flat stranded conductor, the round covering portion is formed continuously with the flat covering portion, and a thickness of the flat covering portion is set to 36.4% or more of a thickness of the round covering portion.

3. A wire harness comprising:

the electric wire according to claim 1.

* * * * *